United States Patent [19]

Kim

[11] Patent Number: 5,032,760

[45] Date of Patent: Jul. 16, 1991

[54] DYNAMIC FOCUS ELECTRON GUN

[75] Inventor: Kyeong-nam Kim, Kyunggi, Rep. of Korea

[73] Assignee: Samsung Electron Devices Co., Ltd., Rep. of Korea

[21] Appl. No.: 438,784

[22] Filed: Nov. 20, 1989

[30] Foreign Application Priority Data

Jun. 10, 1989 [KR] Rep. of Korea ..... 89-8043[U]

[51] Int. Cl.[5] ..... H01J 29/48

[52] U.S. Cl. ..... 313/414

[58] Field of Search ..... 313/409, 412, 414

[56] References Cited

U.S. PATENT DOCUMENTS 4,119,884 10/1978 Blumenberg et al. ..... 313/414 X
4,208,610 6/1980 Schwartz ..... 313/414
4,498,026 2/1985 Yamauchi et al. ..... 313/414
4,737,682 4/1988 Alig et al. ..... 313/414

*Primary Examiner*—Sandra L. O'Shea
*Attorney, Agent, or Firm*—Leydig, Voit & Mayer

[57] ABSTRACT

A dynamic focus electron gun includes a tripolar section for releasing and initially forming electron beams; a focus electrode and a dynamic electrode for pre-accelerating and for prefocusing the electron beams; and an anode for finally accelerating and focusing the electron beams wherein vertical and horizontal blades for forming quadrupole lenses at the respective beam passing holes of the focus electrode and the dynamic electrode are installed within the electrodes. According to the electron gun of the present invention, there is no expectation that arcing might occur between the electrodes, and the voltage resistance characteristics and ease of assembly are improved.

2 Claims, 1 Drawing Sheet

DYNAMIC FOCUS ELECTRON GUN

FIELD OF THE INVENTION

The present invention relates to a dynamic focus electron gun for use in a cathode ray tube and, particularly, to a dynamic focus electron gun in which the structures of the static potential electrode and the dynamic potential electrode comprising quadrupole dynamic focus lenses are improved, thereby upgrading the voltage resistance characteristics of the electron gun, and facilitating its manufacture.

BACKGROUND OF THE INVENTION

The dynamic focus electron gun shown in FIG. 1 comprises a tripolar section consisting of a cathode K, a control grid G1 and a screen grid G2, and a main lens consisting of a static focus electrode G3*s*, a dynamic focus electrode G3*f* and an anode G4. Further, blades BV' and BH' are provided for forming quadrupole lenses above and below beam passing holes 3H*s* disposed at the beam exiting side of a focus electrode G3*s* to which a static potential focus voltage is supplied and at opposite sides of beam passing holes 3Hf disposed at the beam entrance side of a dynamic electrode G3*f* to which a dynamic potential focus voltage is supplied.

Unlike other ordinary dynamic electron guns, the above described dynamic electron gun establishes dynamic electric fields having four poles to form dynamic focus lenses of different chracteristics in the vcertical and horizontal directions. As is well known, such a dynamic focus electron gun properly controls the electron beams by means of the quadrupole lenses which provide variable intensities depending on the positions at which the electron beams strike a screen, so that uniform beam spots are formed over the whole face of the screen.

But the electron gun having the constitution described above has problems as described below. The blades BH', BV' forming the quad polar lenses are exposed to the outside of the electrodes G3*s*, G5*s*, and therefore, the assembling process becomes very difficult. The exposed blades BH', BV' are also installed in a mutually crossing manner, and therefore, arcing between the two blades BH', BV' an occur.

This can be described in detail in the following way for a more thorough understanding. Generally, if the electrodes are to be precisely installed, they should be secured with spacers inserted between them, but in the above described conventional electron gun, the exposure of the blades make it impossible to insert a spacer between the static potential focus electrode G3*s* and the dynamic potential focus electrode G3*f* during assembly, with the result that the gaps between the focus electrodes G3*s* and the focus electrode G3*f* can not be easily adjusted. Further, the blades BV', BH' having sharp edges intersect each other, and therefore, and electric discharge can occur between the focus electrode G3*s* and the dynamic electrode G3*F* when there is a high potential difference between the two electrodes.

SUMMARY OF THE INVENTION

The present invention is intended to overcome the above described disadvantages of the conventional techniques.

Therefore it is the object of the present invention to provide a dynamic focus electron gun which is simple to manufacture, and improved in its voltage resistance characteristics.

In achieving the above object, the dynamic focus electron gun according to the present invention comprises a tripolar section for producing and initially forming a plurality of electron beams, a focus electrode and a dynamic electrode for pre-accelerating and for prefocusing the electron, beams, and an anode for finally accelerating and focusing the electron beams wherein vertical and horizontal blades for forming quadrupole lenses at the respective beam passing holes of the focus electrode and the dynamic electrode are disposed within the respective electrodes so that a predetermined gap is formed between the focus electrode and the dynamic electrode.

Due to the fact that the vertical blade and the horizontal blade for forming the quadrupole lenses are disposed within the inside of the respective relevant electrodes, there is no expectation that arcing might occur between the focus electrode and the dynamic electrode where high potential differences are established. Further spacers can be inserted during the assembling process.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
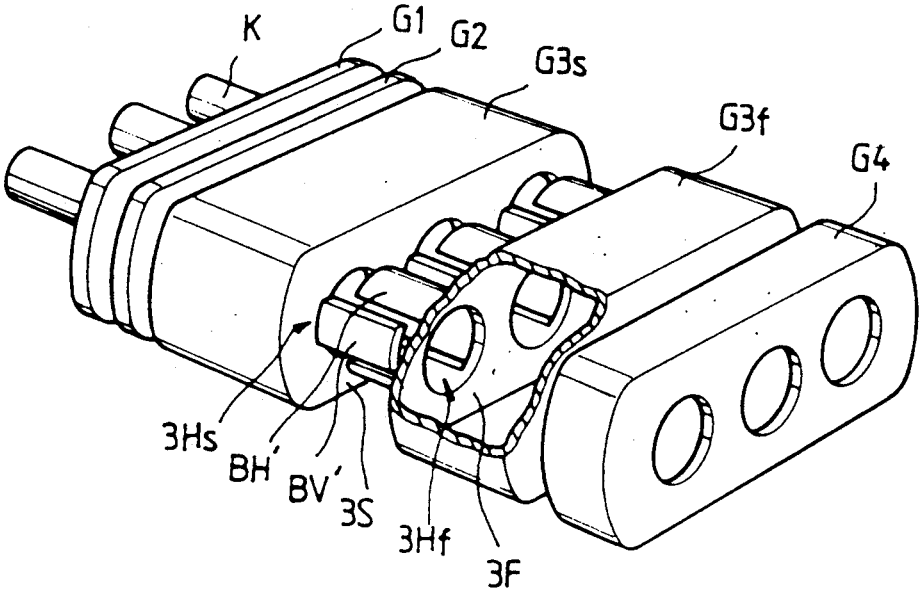
FIG. 1 (Prior Art)
FIG. 1 illustrates a conventional dynamic focus electron gun.
Figure 2:
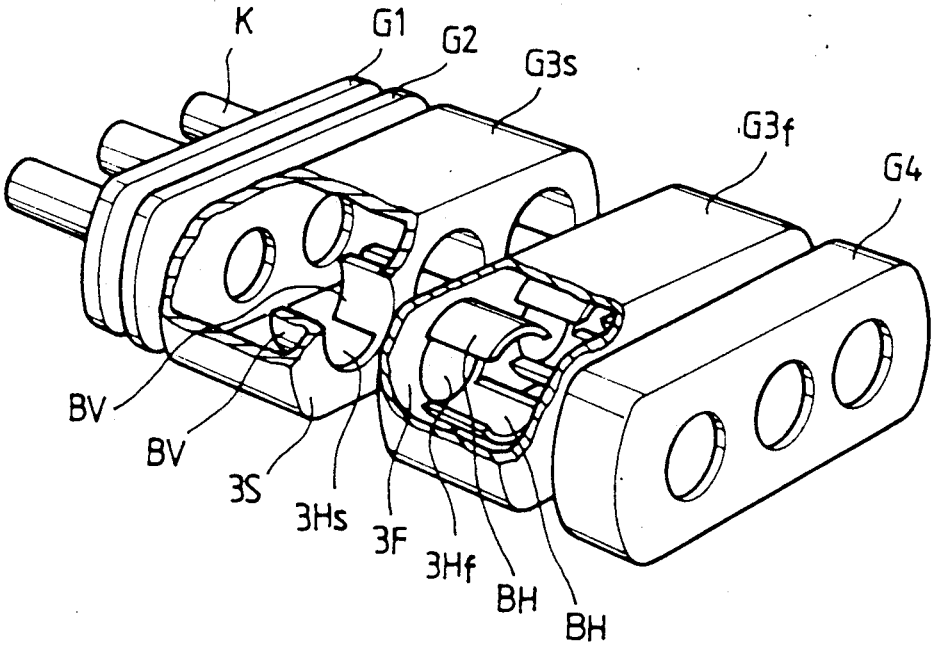
FIG. 2 illustrates an embodiment of the electron gun according to the present invention.

The dynamic focus electron gun according to the present invention will be described referring to FIG. 2.

A cathode K for releasing electrons to a tripolar section, a screen grid G1 for forming the released electrode into beams, and a control grid G2 are arranged in the cited order, while a focus electrode G3*s*, a dynamic electrode G3*f* and an anode G4 are arranged in the cited order to form a main lens. A vertical blade BV and a horizontal blade BH, are respectively installed on the inside of the focus electrode G3*s* at the beam exiting side for controlling the electron beams by means of a dynamic electric field and on the inside of the dynamic electrode G3*f*, at the beam entrance side of the dynamic electrode G3*f*. The blades BV, BH are installed with the vertical blades BV extending a fixed distance into the focus electrode G3*s* facing each other and are horizontally separated from each other, while the horizontal blades BH extend a fixed distance into the dynamic electrode G3*f* facing each other and vertically separated from each other.

The dynamic focus electron gun of the present invention as described above functions such that, when the electron beams which have been formed through the front-disposed tripolar section pass through the quadrupole lens formed between the focus electrode and the dynamic electrode, each of the beams is modified into a vertically elongate shape. That is, when the beams pass through the beam passing hole 3Hs of the focus electrode G3*s*, they are strongly focused in the horizontal direction due to the vertical blades BV disposed at the left and right sides, while, when the beams are passing the beam passing hole 3Hf of the dynamic electrode G3*f*

, they diverge in the vertical direction due to the upper and lower horizontal blades BH.

According to the dynamic focus electron gun of the present invention the electron beams are not simultaneously focused (horizontally) and diverged (vertically) at the same position but, unlike the conventional methods, are subjected to horizontal focusing and vertical divergence sequentially with an intervening interval.

According to the dynamic focus electron gun of the present invention described above, the horizontal and vertical blades forming the quadrupole lenses project into the associated electrodes, and, therefore, there is no expectation that arcing might occur. Further, spacers can be inserted between the electrodes during the assembly process so that the assembly is facilitated, with the result that the dynamic focus electron gun of the present invention has high voltage resistance characteristics and is more easily assembled.

What is claimed is:

1. A dynamic focus electron gun comprising:

a cathode, screen grid, and control grid for releasing electrons and forming a plurality of electron beams;

a focus electrode and a dynamic electrode for initially accelerating and focusing said electron beams, said focus and dynamic electrodes each enclosing a volume and respectively including a plurality of mutually aligned, opposed electron beam exit holes and entrance holes; and an anode for finally accelerating and focusing said electron beams passing out of the electron beam exit holes of said focus electrode and into the electrode beam entrance holes of said dynamic electrode wherein each of said focus and dynamic electrodes includes a pair of opposed blades extending into said volume of said focus and dynamic electrodes contiguous to each of the electron beam exit and entrance holes, said pairs of blades within said focus electrode being oriented generally orthogonally to said pairs of blades disposed within said dynamic electrode and forming a quadrupole lens.

2. The dynamic focus electron gun of claim 1 wherein said respective pairs of blades respectively project a predetermined distance within said focus and dynamic electrodes.

* * * * *

UNITED STATES PATENT AND TRADEMARK OFFICE

CERTIFICATE OF CORRECTION

PATENT NO. : 5,032,760

DATED : July 16, 1991

INVENTOR(S) : Kyeong-nam Kim

It is certified that error appears in the above-identified patent and that said Letters Patent is hereby corrected as shown below:

Column 4, lines 9 and 10, change "electrode" to read --electron--.

Signed and Sealed this

Twenty-third Day of March, 1993

*Attest:*

STEPHEN G. KUNIN

*Attesting Officer*

*Acting Commissioner of Patents and Trademarks*